US011049432B2

(12) United States Patent
Kim et al.

(10) Patent No.: US 11,049,432 B2
(45) Date of Patent: Jun. 29, 2021

(54) DISPLAY APPARATUS AND METHOD OF DRIVING DISPLAY PANEL USING THE SAME

(71) Applicant: Samsung Display Co., Ltd., Yongin-Si (KR)

(72) Inventors: Mingyu Kim, Hwaseong-si (KR); Hoisik Moon, Hwaseong-si (KR); Hee Joon Kim, Yongin-si (KR); Juneyoung Lee, Seoul (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 16/701,753

(22) Filed: Dec. 3, 2019

(65) Prior Publication Data

US 2020/0175910 A1 Jun. 4, 2020

(30) Foreign Application Priority Data

Dec. 4, 2018 (KR) ..... 10-2018-0154299

(51) Int. Cl.
*G09G 3/20* (2006.01)
*G09G 3/36* (2006.01)
(Continued)

(52) U.S. Cl.
CPC ..... *G09G 3/2007* (2013.01); *G09G 3/3266* (2013.01); *G09G 3/3275* (2013.01);
(Continued)

(58) Field of Classification Search
CPC ..... G09G 3/2007; G09G 3/2074; G09G 2300/0426; G09G 2310/027; G09G 2310/08; G09G 2320/0223; G09G 2320/0285; G09G 2320/0693; G09G 2330/08; G09G 2340/16; G09G 3/3266; G09G 3/3275; G09G 3/3674; G09G 3/3685; G09G 3/20; G09G 3/2092; G09G 3/3688; G09G 2310/0251; G09G 2310/0267; G09G 2320/0233; G09G 2320/0252;
(Continued)

(56) References Cited

U.S. PATENT DOCUMENTS

2010/0156949 A1* 6/2010 Park ..... G09G 3/3607 345/690
2015/0022512 A1* 1/2015 Ahn ..... G09G 3/3659 345/212
2017/0287418 A1* 10/2017 Hwang ..... G09G 3/3607

FOREIGN PATENT DOCUMENTS

KR 1020150030013 A 3/2015
KR 1020160102285 A 8/2016
(Continued)

*Primary Examiner* — Nelson M Rosario
(74) *Attorney, Agent, or Firm* — Cantor Colburn LLP

(57) ABSTRACT

A display apparatus includes a display panel, a driving controller, a gate driver and a data driver. The display panel includes a plurality of gate lines, a plurality of data lines and a plurality of pixels. The pixels are connected to the gate lines and the data lines. The driving controller determines a compensating value of a present data signal based on a previous data signal and the present data signal which are applied to a same data line of the data lines. The gate driver outputs a gate signal to the gate line. The data driver generates a data voltage based on the present data signal and the compensating value and outputs the data voltage to the same data line.

20 Claims, 14 Drawing Sheets

| REFERENCE COMPENSATING VALUE | | N-1 | COMPENSATING RATIO | | N-1 | | | | | | | |
|---|---|---|---|---|---|---|---|---|---|---|---|---|
| | | 0 | | | 0 | 16 | 24 | 32 | 64 | 128 | 192 | 255 |
| N | 16 | CMA | N | 16 | 1 | | | | | | | |
| | 24 | CMB | | 24 | 1 | | | | | | | |
| | 32 | CMC | | 32 | 1 | | | | | | | |
| | 64 | CMD | | 64 | 1 | | | | | | | |
| | 128 | CME | | 128 | 1 | 0.6 | 0.536 | 0.514 | 0.328 | 0.04 | -0.18 | -0.51 |
| | 192 | CMF | | 192 | 1 | | | | | | | |
| | 255 | CMG | | 255 | 1 | | | | | | | |

(51) Int. Cl.
*G09G 3/3266* (2016.01)
*G09G 3/3275* (2016.01)

(52) U.S. Cl.
CPC ..... *G09G 3/3674* (2013.01); *G09G 3/3685* (2013.01); *G09G 2310/027* (2013.01); *G09G 2310/08* (2013.01); *G09G 2320/0285* (2013.01); *G09G 2330/08* (2013.01); *G09G 2340/16* (2013.01)

(58) Field of Classification Search
CPC ..... G09G 2360/12; G09G 3/2096; G09G 2340/02; G09G 2340/06; G09G 2360/16; G09G 3/3611; H04N 19/12; H04N 19/136; H04N 19/176; H04N 19/593; H04N 19/625
See application file for complete search history.

(56) References Cited

FOREIGN PATENT DOCUMENTS

| | | | |
|---|---|---|---|
| KR | 1020180035994 | A | 4/2018 |
| KR | 1020180061511 | A | 6/2018 |

* cited by examiner

FIG. 3

| REFERENCE COMPENSATING VALUE | | N-1 | COMPENSATING RATIO | | N-1 | | | | | | | |
|---|---|---|---|---|---|---|---|---|---|---|---|---|
| | | 0 | | | 0 | 16 | 24 | 32 | 64 | 128 | 192 | 255 |
| N | 16 | CMA | N | 16 | 1 | | | | | | | |
| | 24 | CMB | | 24 | 1 | | | | | | | |
| | 32 | CMC | | 32 | 1 | | | | | | | |
| | 64 | CMD | | 64 | 1 | | | | | | | |
| | 128 | CME | | 128 | 1 | 0.6 | 0.536 | 0.514 | 0.328 | 0.04 | -0.18 | -0.51 |
| | 192 | CMF | | 192 | 1 | | | | | | | |
| | 255 | CMG | | 255 | 1 | | | | | | | |

DISPLAY APPARATUS AND METHOD OF DRIVING DISPLAY PANEL USING THE SAME

This application claims priority to Korean Patent Application No. 10-2018-0154299, filed on Dec. 4, 2018, and all the benefits accruing therefrom under 35 U.S.C. § 119, the content of which in its entirety is herein incorporated by reference.

BACKGROUND

1. Field

Exemplary embodiments of the present inventive concept relate to a display apparatus and a method of driving a display panel using the display apparatus. More particularly, exemplary embodiments of the present inventive concept relate to a display apparatus compensating a lack of a charging rate due to a defect of a data line to enhance a display quality and a method of driving a display panel using the display apparatus.

2. Description of the Related Art

A display apparatus includes a display panel and a display panel driver. The display panel includes a plurality of gate lines, a plurality of data lines and a plurality of subpixels. The display panel driver includes a gate driver, a data driver and a driving controller. The gate driver outputs gate signals to the gate lines. The data driver outputs data voltages to the data lines. The driving controller controls the gate driver and the data driver.

A defect of the data line of the display panel may be generated in a manufacturing step. A charging rate of the pixel connected to the defective data line may be lacked so that a display defect may be generated.

SUMMARY

Exemplary embodiments of the present inventive concept are directed to a display apparatus compensating a present data signal using a previous data signal and the present data signal which are applied to a defected data line.

Exemplary embodiments of the present inventive concept also provide a method of driving a display panel using the above-mentioned display apparatus.

In an exemplary embodiment of a display apparatus according to the present inventive concept, the display apparatus includes a display panel, a driving controller, a gate driver and a data driver. The display panel includes a plurality of gate lines, a plurality of data lines and a plurality of pixels, and the pixels are connected to the gate lines and the data lines. The driving controller determines a compensating value of a present data signal based on a previous data signal and the present data signal which are applied to a same data line of the data lines. The gate driver outputs a gate signal to the gate line. The data driver generates a data voltage based on the present data signal and the compensating value and outputs the data voltage to the same data line.

In an exemplary embodiment, the driving controller may determine the compensating value such that a charging rate of a second pixel connected to a defected data line of the data lines among the pixels becomes equal to a charging rate of a first pixel connected to a normal data line of the data lines among the pixels.

In an exemplary embodiment, the driving controller may determine the compensating value such that a charging rate of a pixel connected to a defected data line of the data lines among the pixels becomes equal to a target charging rate.

In an exemplary embodiment, the driving controller may generate the compensating value of the present data signal as a reference compensating value based on determination that the previous data signal represents a minimum grayscale value and the present data signal represents a first grayscale value. The driving controller may generate a ratio of the compensating value to the reference compensating value as a compensating ratio based on determination that the previous data signal represents a second grayscale value of a non-minimum grayscale value and the present data signal represents the first grayscale value.

In an exemplary embodiment, the compensating value may be decreased as the grayscale value of the previous data signal increases in a same grayscale value of the present data signal.

In an exemplary embodiment, the compensating value may be increased as the grayscale value of the present data signal increases in a same grayscale value of the previous data signal.

In an exemplary embodiment, the driving controller may store the reference compensating value and the compensating ratio using a table form. The reference compensating value may include first reference compensating values and second reference compensating values, and the compensating ratio may include first compensating ratios and second compensating ratios. The driving controller may store a first table including the first reference compensating values and the first compensating ratios for a first defected data line of the data lines and a second table including the second reference compensating values and the second compensating ratios for a second defected data line of the data lines.

In an exemplary embodiment, the driving controller may store the reference compensating value and the compensating ratio using a table form. The reference compensating value may include first reference compensating values and second reference compensating values, and the compensating ratio may include first compensating ratios and second compensating ratios. The driving controller may store a first table including the first reference compensating values and the first compensating ratios for a first position of a first defected data line of the data lines and a second table including the second reference compensating values and the second compensating ratios for a second position of the first defected data line.

In an exemplary embodiment, the driving controller may store the reference compensating value and the compensating ratio using a table form. The reference compensating value may include first, second, third and fourth reference compensating values, and the compensating ratio may include first, second, third and fourth compensating ratios. The driving controller may store a first table including the first reference compensating values and the first compensating ratios for a first position of a first defected data line of the data lines, a second table including the second reference compensating values and the second compensating ratios for a second position of the first defected data line, a third table including the third reference compensating values and third the compensating ratios for a third position of a second defected data line of the data lines and a fourth table including the fourth reference compensating values and the fourth compensating ratios for a fourth position of the second defected data line.

In an exemplary embodiment, the display panel may include a first pixel connected to a second data line of the data lines and disposed in a first pixel row and a first pixel column, a second pixel connected to a third data line of the data lines and disposed in the first pixel row and a second pixel column, a third pixel connected to a first data line of the data lines and disposed in a second pixel row and the first pixel column and a fourth pixel connected to the second data line and disposed in the second pixel row and the second pixel column. The compensating value of the fourth pixel may be generated based on a data signal of the first pixel and a data signal of the fourth pixel, and the plurality of pixels may include the first, second, third and fourth pixels.

In an exemplary embodiment, the display panel may include a first pixel connected to a first data line of the data lines and disposed in a first pixel row and a first pixel column, a second pixel connected to a second data line of the data lines and disposed in the first pixel row and a second pixel column, a third pixel connected to the first data line and disposed in a second pixel row and the first pixel column and a fourth pixel connected to the second data line and disposed in the second pixel row and the second pixel column. The compensating value of the third pixel may be generated based on a data signal of the first pixel and a data signal of the third pixel, and the plurality of pixels may include the first, second, third and fourth pixels.

In an exemplary embodiment, the display panel may include a first pixel connected to a second data line of the data lines and disposed in a first pixel row and a first pixel column, a second pixel connected to a third data line of the data lines and disposed in the first pixel row and a second pixel column, a third pixel connected to the second data line and disposed in a second pixel row and the first pixel column, a fourth pixel connected to the third data line and disposed in the second pixel row and the second pixel column, a fifth pixel connected to the second data line and disposed in a third pixel row and the first pixel column, a sixth pixel connected to the third data line and disposed in the third pixel row and the second pixel column, a seventh pixel connected to a first data line of the data lines and disposed in a fourth pixel row and the first pixel column and an eighth pixel connected to the second data line and disposed in the fourth pixel row and the second pixel column. The compensating value of the fifth pixel may be generated based on a data signal of the third pixel and a data signal of the fifth pixel. The compensating value of the eighth pixel may be generated based on the data signal of the fifth pixel and a data signal of the eighth pixel, and the plurality of pixels may include the first to eighth pixels.

In an exemplary embodiment of a method of driving a display panel according to the present inventive concept, the method includes determining a compensating value of a present data signal based on a previous data signal and the present data signal which are applied to a same data line of a plurality of data lines, generating a data voltage based on the present data signal and the compensating value and outputting the data voltage to the same data line of the display panel.

In an exemplary embodiment, the compensating value of the present data signal may be determined such that a charging rate of a second pixel connected to a defected data line of the data lines becomes equal to a charging rate of a first pixel connected to a normal data line of the data lines.

In an exemplary embodiment, the compensating value of the present data signal may be determined such that a charging rate of a pixel connected to a defected data line of the data lines becomes equal to a target charging rate.

In an exemplary embodiment, the determining the compensating value of the present data signal may include generating the compensating value of the present data signal as a reference compensating value based on determination that the previous data signal represents a minimum grayscale value and the present data signal represents a first grayscale value and generating a ratio of the compensating value to the reference compensating value as a compensating ratio based on determination that the previous data signal represents a second grayscale value of a non-minimum grayscale value and the present data signal represents the first grayscale value.

In an exemplary embodiment, the compensating value may be decreased as the grayscale value of the previous data signal increases in a same grayscale value of the present data signal.

In an exemplary embodiment, the compensating value may be increased as the grayscale value of the present data signal increases in a same grayscale value of the previous data signal.

In an exemplary embodiment, the reference compensating value may include first and second reference compensating values, and the compensating ratio may include first and second compensating ratios. The determining the compensating value of the present data signal may include storing a first table including the first reference compensating values and the first compensating ratios for a first defected data line of the data lines and storing a second table including the second reference compensating values and the second compensating ratios for a second defected data line of the data lines.

In an exemplary embodiment, the reference compensating value may include first and second reference compensating values, and the compensating ratio may include first and second compensating ratios. The determining the compensating value of the present data signal may include storing a first table including the first reference compensating values and the first compensating ratios for a first position of a first defected data line of the data lines and storing a second table including the second reference compensating values and the second compensating ratios for a second position of the first defected data line.

According to the display apparatus and the method of driving the display panel using the display apparatus, the present data signal may be compensated using the previous data signal and the present data signal applied to the defected data line. Thus, the lack of the charging rate due to the defect of the data line may be compensated in a unit of the data line. Therefore, the display defect may be prevented so that the display quality of the display panel may be enhanced.

BRIEF DESCRIPTION OF THE DRAWINGS

The above and other features and advantages of the present inventive concept will become more apparent by describing in detailed exemplary embodiments thereof with reference to the accompanying drawings, in which:

FIG. 3 is an exemplary embodiment of a table illustrating a reference compensating value and a compensating ratio which are generated by a driving controller of FIG. 1;

DETAILED DESCRIPTION

Hereinafter, the present inventive concept will be explained in detail with reference to the accompanying drawings.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
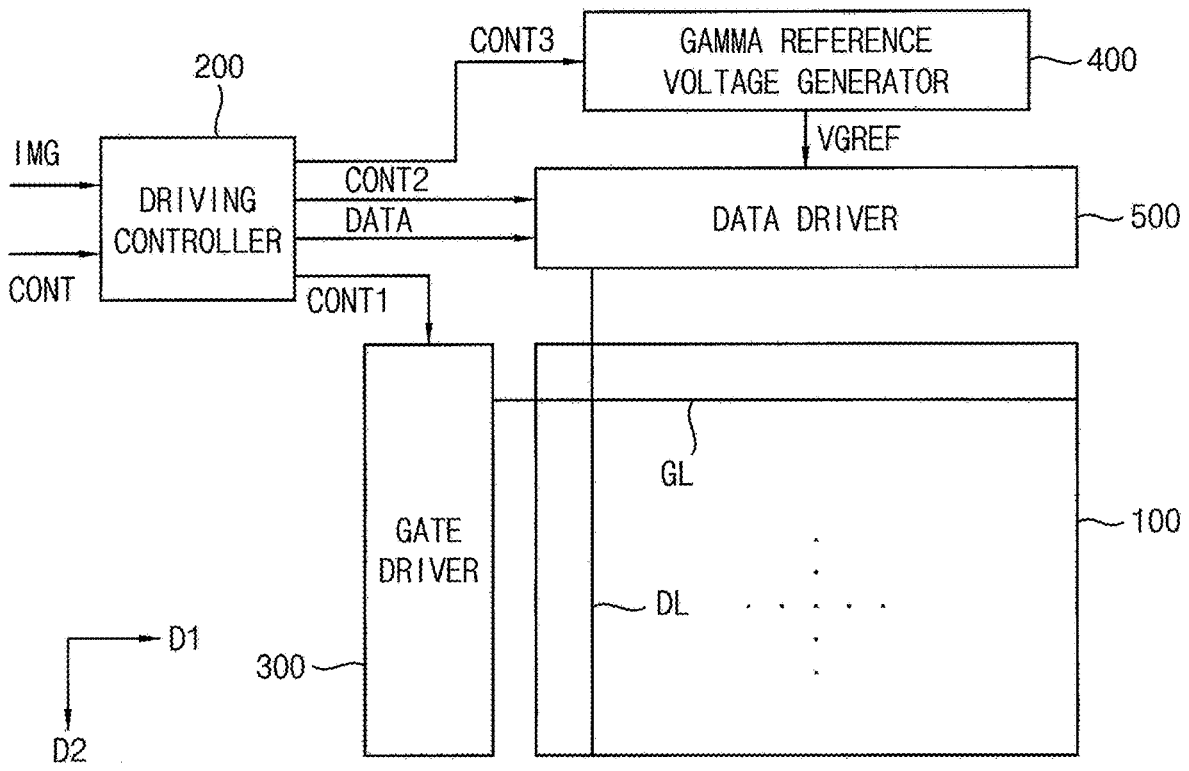
FIG. 1 is a block diagram illustrating an exemplary embodiment of a display apparatus according to the present inventive concept.

FIG. 1 is a block diagram illustrating an exemplary embodiment of a display apparatus according to the present inventive concept.

Referring to FIG. 1, the display apparatus includes a display panel 100 and a display panel driver. The display panel driver includes a driving controller 200, a gate driver 300, and a data driver 500 and optionally includes a gamma reference voltage generator 400.

For example, the driving controller 200 and the data driver 500 may be integrally provided. For example, the driving controller 200, the gamma reference voltage generator 400 and the data driver 500 may be integrally provided. For example, the driving controller 200, the gate driver 300, the gamma reference voltage generator 400 and the data driver 500 may be integrally provided.

The display panel 100 includes a display region and a peripheral region adjacent to the display region.

For example, the display panel 100 may be a liquid crystal display panel including liquid crystal molecules. Alternatively, the display panel 100 may be an organic light emitting diode display panel including organic light emitting diodes.

The display panel 100 includes a plurality of gate lines GL, a plurality of data lines DL and a plurality of subpixels electrically connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG The driving controller 200 outputs the data signal DATA to the data driver 500.

The driving controller 200 may generate the third control signal CONT3 for controlling an operation of the gamma reference voltage generator 400 based on the input control signal CONT, and output the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL.

The gamma reference voltage generator 400 may generate a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and may receive the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
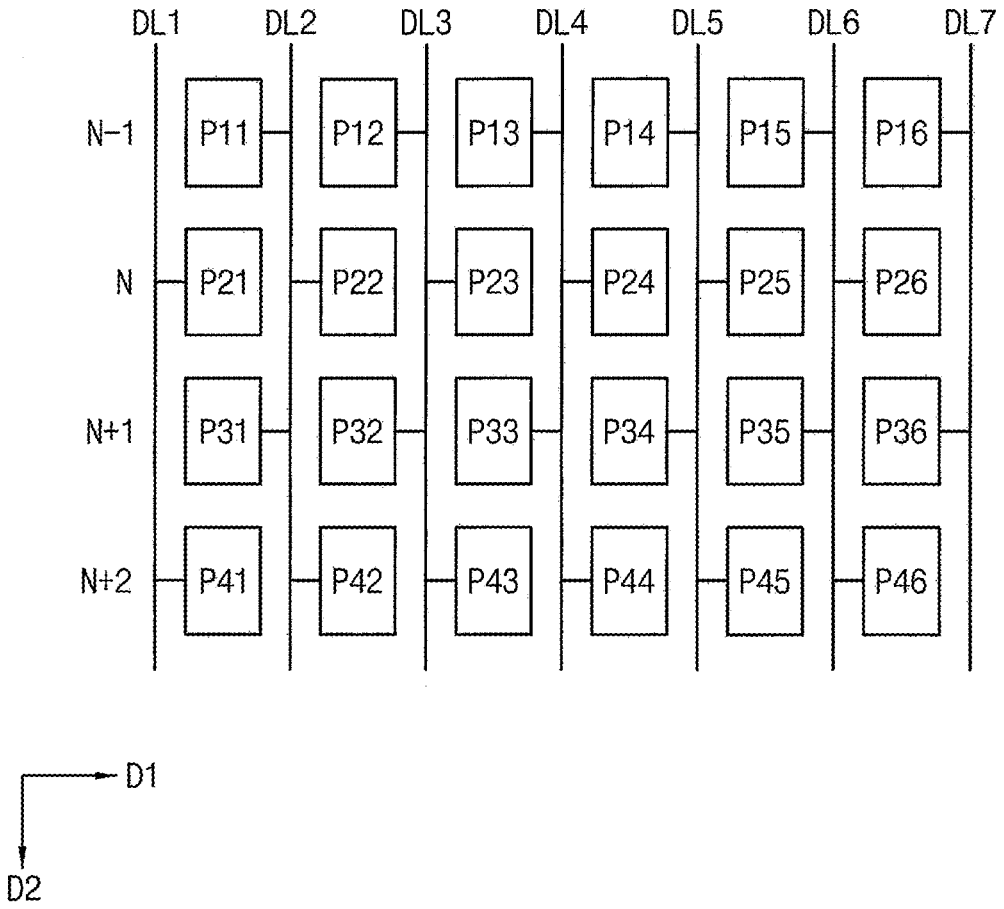
FIG. 2 is a conceptual diagram illustrating an exemplary embodiment of a pixel structure of a display panel of FIG. 1.

FIG. 2 is a conceptual diagram illustrating an exemplary embodiment of a pixel structure of the display panel 100 of FIG. 1.

Referring to FIGS. 1 and 2, the display panel 100 includes a plurality of pixels disposed in a matrix form. The pixel may have a shorter side extending in the first direction D1 and a longer side extending in the second direction D2.

In the present exemplary embodiment, the data line may be alternatively connected to pixels disposed in two adjacent pixel columns as shown in FIG. 2. For example, a second data line DL2 may be connected to pixels P11 and P31 in a first pixel column and pixels P22 and P42 in a second pixel column. For example, a third data line DL3 may be connected to pixels P12 and P32 in the second pixel column and pixels P23 and P43 in a third pixel column. For example, a fourth data line DL4 may be connected to pixels P13 and P33 in the third pixel column and pixels P24 and P44 in a fourth pixel column. For example, a fifth data line DL5 may be connected to pixels P14 and P34 in the fourth pixel column and pixels P25 and P45 in a fifth pixel column. For example, a sixth data line DL6 may be connected to pixels P15 and P35 in the fifth pixel column and pixels P26 and P46 in a sixth pixel column.

Although not shown in figures, pixels in a first pixel row N−1 may be connected to a first gate line, pixels in a second pixel row N may be connected to a second gate line, pixels in a third pixel row N+1 may be connected to a third gate line and pixels in a fourth pixel row N+2 may be connected to a fourth gate line.

Although the pixels in the four by six matrix are illustrated in FIG. 2 for convenience of explanation, the display panel 100 may include pixels other than the pixels in the four by six matrix.

For example, the pixels P11, P21, P31 and P41 in the first pixel column and the pixels P14, P24, P34 and P44 in the fourth pixel column may be first color pixels having a first color. For example, the pixels P12, P22, P32 and P42 in the second pixel column and the pixels P15, P25, P35 and P45 in the fifth pixel column may be second color pixels having a second color. For example, the pixels P13, P23, P33 and P43 in the third pixel column and the pixels P16, P26, P36 and P46 in the sixth pixel column may be third color pixels having a third color.

FIG. 3 is an exemplary embodiment of a table illustrating a reference compensating value and a compensating ratio which are generated by the driving controller 200 of FIG. 1.

Referring to FIGS. 1 to 3, the driving controller 200 determines a compensating value of a present data signal based on a previous data signal and the present data signal which are applied to the same data line. For example, the driving controller 200 determines a compensating value of the present data signal which is applied to the pixel P22 based on the previous data signal applied to the pixel P11 and the present data signal applied to the pixel P22 which are applied to the second data line DL2 in FIG. 2. For example, the driving controller 200 determines a compensating value of the present data signal which is applied to the pixel P31 based on the previous data signal applied to the pixel P22 and the present data signal applied to the pixel P31 which are applied to the second data line DL2 in FIG. 2. For example, the driving controller 200 determines a compensating value of the present data signal which is applied to the pixel P42 based on the previous data signal applied to the pixel P31 and the present data signal applied to the pixel P42 which are applied to the second data line DL2 in FIG. 2.

For example, the driving controller 200 may determine the compensating value such that a charging rate of a second pixel connected to a defected data line becomes equal to a charging rate of a first pixel connected to a normal data line after compensation.

In an exemplary embodiment, in the cases that the third data line DL3 is the normal data line and the second data line DL2 is the defected data line, the compensating value of the pixel P22 may be determined such that the charging rate of the pixel P22 connected to the second data line DL2 becomes equal to the charging rate of the pixel P32 connected to the third data line DL3 after the compensation. For example, the charging rate of the pixel P22 and the charging rate of the pixel P32 may be determined by a photo sensor.

In an alternative exemplary embodiment, the compensating value of the pixel connected to the defected data line may be determined such that the charging rate of the pixel connected to the defected data line becomes equal to a target charging rate after the compensation. For example, the target charging rate may be set to an average charging rate of the pixels in the display panel 100.

In the cases that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the cases that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio using a table form.

In an exemplary embodiment, as shown in FIG. 3, the driving controller 200 may generate the compensating value in the previous data signal of the minimum grayscale value (e.g. zero grayscale) and the present data signal of 16 grayscale as the reference compensating value CMA of 16 grayscale. The driving controller 200 may generate the compensating value in the previous data signal of the minimum grayscale value and the present data signal of 24 grayscale as the reference compensating value CMB of 24 grayscale. The driving controller 200 may generate the compensating value in the previous data signal of the minimum grayscale value and the present data signal of 32 grayscale as the reference compensating value CMC of 32 grayscale. The driving controller 200 may generate the compensating value in the previous data signal of the minimum grayscale value and the present data signal of 64 grayscale as the reference compensating value CMD of 64 grayscale. The driving controller 200 may generate the compensating value in the previous data signal of the minimum grayscale value and the present data signal of 128 grayscale as the reference compensating value CME of 128 grayscale. The driving controller 200 may generate the compensating value in the previous data signal of the minimum grayscale value and the present data signal of 192 grayscale as the reference compensating value CMF of 192 grayscale. The driving controller 200 may generate the compensating value in the previous data signal of the minimum grayscale value and the present data signal of 255 grayscale as the reference compensating value CMG of 255 grayscale.

In an exemplary embodiment, reference compensating values of grayscales which are not illustrated in the table of FIG. 3 may be generated by an interpolation of the reference compensating values in the table of FIG. 3.

As shown in FIG. 3, the driving controller 200 may store a first compensating ratio (e.g. 0.6), which is, for example, a ratio of the compensating value in the previous data signal of 16 grayscale and the present data signal of 128 grayscale to the reference compensating value CME of 128 grayscale, in the table. The driving controller 200 may store a second compensating ratio (e.g. 0.536), which is a ratio of the compensating value in the previous data signal of 24 grayscale and the present data signal of 128 grayscale to the reference compensating value CME of 128 grayscale, in the table. The driving controller 200 may store a third compensating ratio (e.g. 0.514), which is a ratio of the compensating value in the previous data signal of 32 grayscale and the present data signal of 128 grayscale to the reference compensating value CME of 128 grayscale, in the table. The driving controller 200 may store a fourth compensating ratio (e.g. 0.328), which is a ratio of the compensating value in the previous data signal of 64 grayscale and the present data signal of 128 grayscale to the reference compensating value CME of 128 grayscale, in the table. The driving controller 200 may store a fifth compensating ratio (e.g. 0.04), which is a ratio of the compensating value in the previous data signal of 128 grayscale and the present data signal of 128 grayscale to the reference compensating value CME of 128 grayscale, in the table. The driving controller 200 may store a sixth compensating ratio (e.g. −0.18), which is a ratio of the compensating value in the previous data signal of 192 grayscale and the present data signal of 128 grayscale to the reference compensating value CME of 128 grayscale, in the table. The driving controller 200 may store a seventh compensating ratio (e.g. −0.51), which is a ratio of the compensating value in the previous data signal of 255 grayscale and the present data signal of 128 grayscale to the reference compensating value CME of 128 grayscale, in the table. Here, the compensating ratio may have a minus value since the compensating value in the previous data signal and the present data signal may have a minus value.

After the compensating ratio is generated, for example, the compensating value of the present data signal in the previous data signal of 16 grayscale and the present data signal of 128 grayscale may be generated as CME*0.6 (i.e., the product of the reference compensating value CME of 128 grayscale and the compensating ratio in the previous data signal of 16 grayscale and the present data signal of 128 grayscale), the compensating value in the previous data signal of 24 grayscale and the present data signal of 128 grayscale may be generated as CME*0.536 (i.e., the product of the reference compensating value CME of 128 grayscale and the compensating ratio in the previous data signal of 24 grayscale and the present data signal of 128 grayscale), and the compensating value in the previous data signal of 192 grayscale and the present data signal of 128 grayscale may be generated as CME*−0.18 (i.e., the product of the reference compensating value CME of 128 grayscale and the compensating ratio in the previous data signal of 192 grayscale and the present data signal of 128 grayscale).

Assuming that the grayscale value of the present data signal N is fixed, as the grayscale value of the previous data signal N−1 increases, the compensating value may be decreased. As shown in FIG. 3, in the case that the grayscale value of the present data signal N is 128 grayscale, as the grayscale value of the previous data signal N−1 increases from zero grayscale to 255 grayscale, the compensating value decreases from 1 to a minus value.

In the same grayscale value of the previous data signal N−1, as the grayscale value of the present data signal N increases, the compensating value also may be increased. The compensating value to compensate the present data signal of a high grayscale value may be greater than the compensating value to compensate the present data signal of a low grayscale value.

Compensating ratios of grayscales which are not illustrated in the table of FIG. 3 may be generated by an interpolation of the compensating ratios in the table of FIG. 3.

In the present exemplary embodiment, the display panel 100 may include a first pixel P11 connected to the second data line DL2 and disposed in the first pixel row N−1 and the first pixel column, a second pixel P12 connected to the third data line DL3 and disposed in the first pixel row N−1 and the second pixel column, a third pixel P21 connected to a first data line DL1 and disposed in the second pixel row N and the first pixel column, and a fourth pixel P22 connected to the second data line DL2 and disposed in the second pixel row N and the second pixel column. The compensating value of the fourth pixel P22 may be generated based on the data signal of the first pixel P11 and the data signal of the fourth pixel P22.

Figure 4:
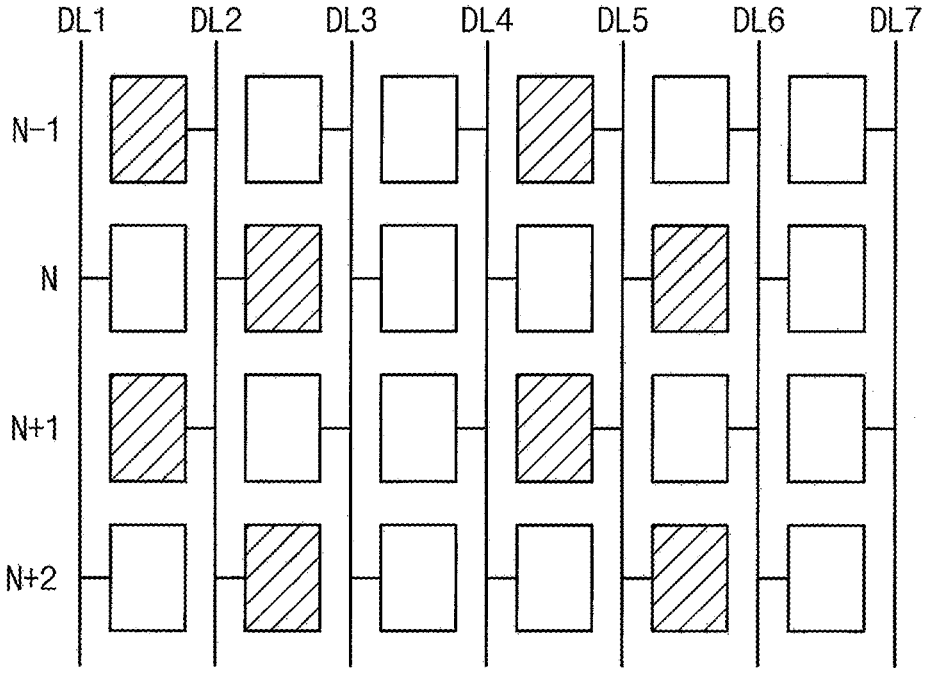
FIG. 4 is a conceptual diagram illustrating the display panel of FIG. 2 which displays a first image.
Figure 5A:
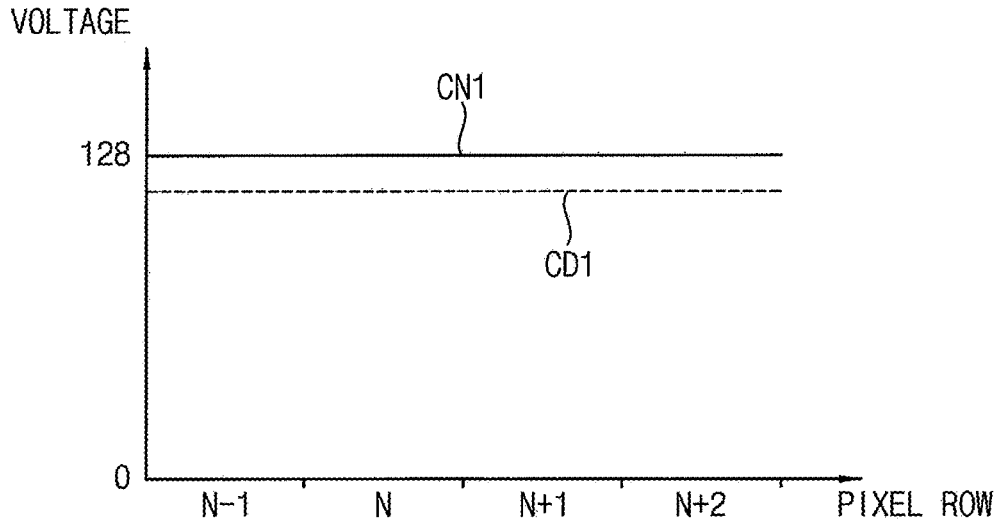
FIG. 5A is a graph illustrating a lack of a charging rate of a defected data line when the display panel of FIG. 2 displays the first image.
Figure 5B:
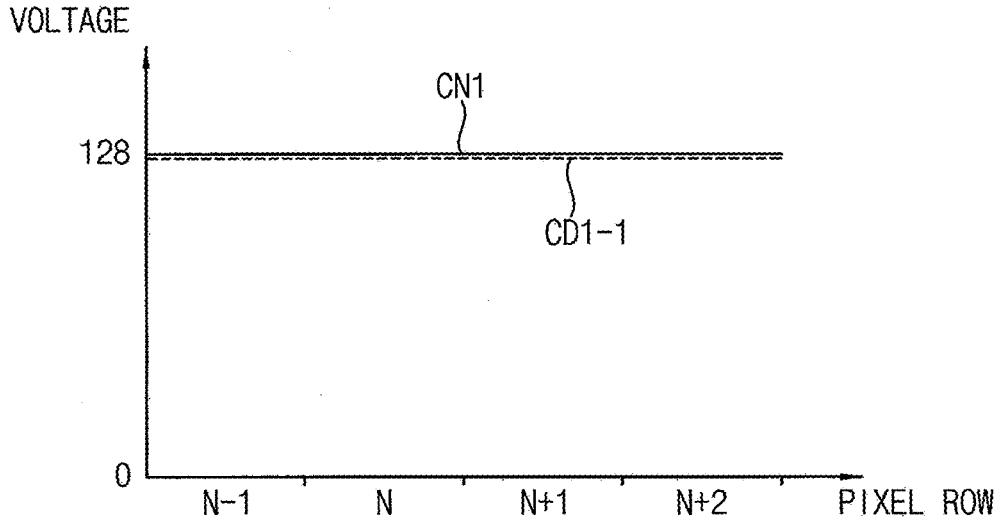
FIG. 5B is a graph illustrating compensation of the charging rate of the defected data line when the display panel of FIG. 2 displays the first image.

FIG. 4 is a conceptual diagram illustrating the display panel 100 of FIG. 2 which displays a first image. FIG. 5A is a graph illustrating a lack of a charging rate of a defected data line DL2 when the display panel 100 of FIG. 2 displays the first image. FIG. 5B is a graph illustrating compensation of the charging rate of the defected data line DL2 when the display panel 100 of FIG. 2 displays the first image.

Referring to FIGS. 1 to 5B, for example, the data signal having 128 grayscale may be applied to the second data line DL2 and the fifth data line DL5 and the data signal having zero grayscale may be applied to the third data line DL3 and the fourth data line DL4. Herein, it is assumed that the second data line DL2 may be the defected data line and the fifth data line DL5 may be the normal data line.

The charging rate of the pixels connected to the defected data line may be reduced. Thus, a data voltage corresponding to 128 grayscale may be charged to the pixels connected to the normal data line DL5 as illustrated as a first voltage CN1 of FIG. 5A and a data voltage less than the data voltage corresponding to 128 grayscale may be charged to the pixels connected to the defected data line DL2 as illustrated as a second voltage CD1 of FIG. 5A. Thus, the lack of the charging rate of the pixels connected to the defected data line DL2 may generate the display defect.

The driving controller 200 may compensate the present data signal based on the previous data signal and the present data signal which are applied to the defected data line DL2. For example, the lack of the charging rate of the present data signal (the data signal corresponding to the N-th pixel row) may be compensated based on the previous data signal (the data signal corresponding to the (N−1)-th pixel row) and the present data signal (the data signal corresponding to the N-th pixel row). For another example, the lack of the charging rate of another present data signal (the data signal corresponding to the (N+1)-th pixel row) may be compensated based on another previous data signal (the data signal corresponding to the N-th pixel row) and the another present data signal (the data signal corresponding to the (N+1)-th pixel row).

As shown as a second compensated voltage CD1-1 of FIG. 5B, the charging rate of the pixels connected to the defected data line DL2 may be compensated to be equal to the charging rate of the pixels connected to the normal data line DL5. Thus, the display defect due to the lack of the charging rate of the defected data line may be prevented.

Figure 6:
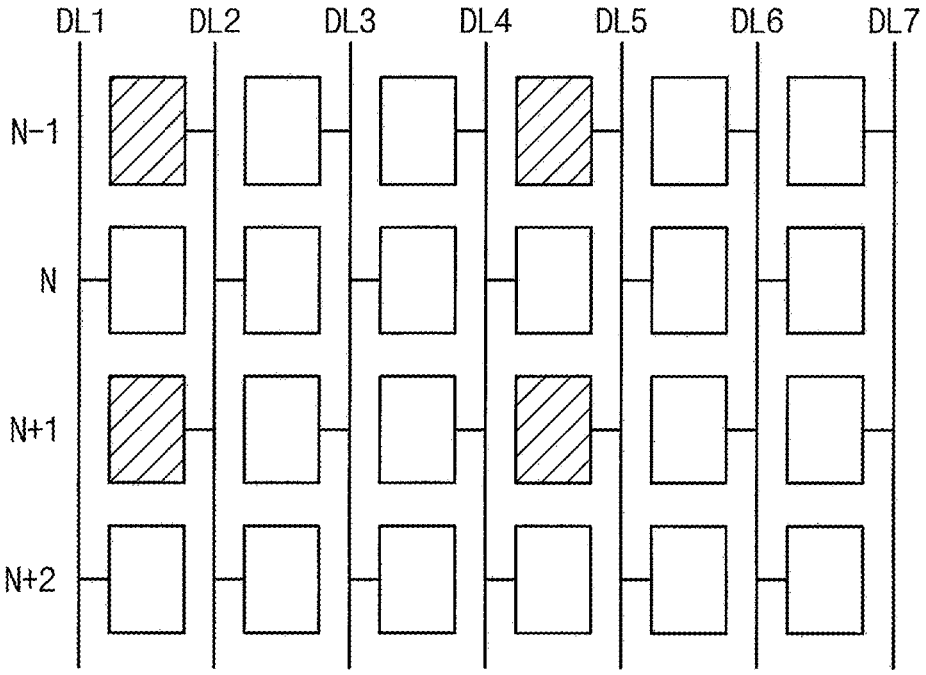
FIG. 6 is a conceptual diagram illustrating the display panel of FIG. 2 which displays a second image.
Figure 7A:
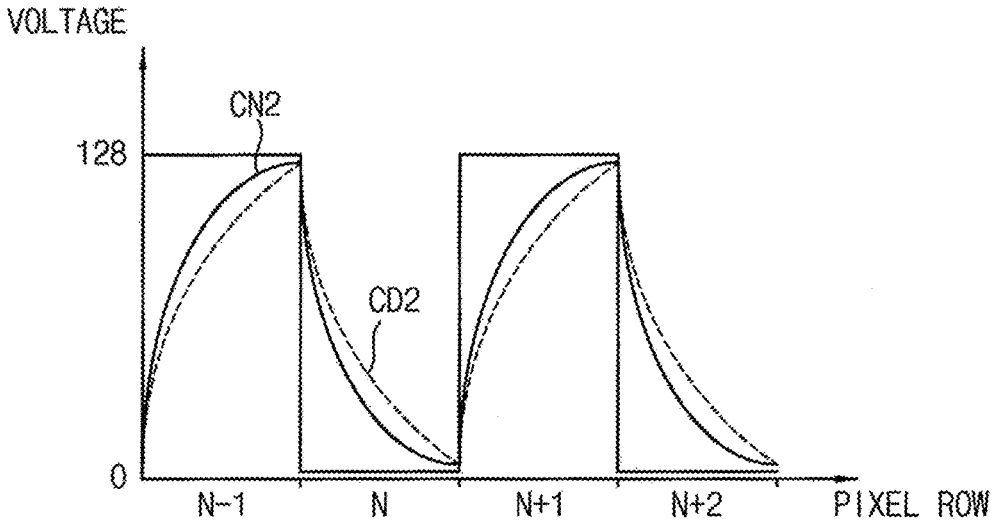
FIG. 7A is a graph illustrating a lack of a charging rate of the defected data line when the display panel of FIG. 2 displays the second image.
Figure 7B:
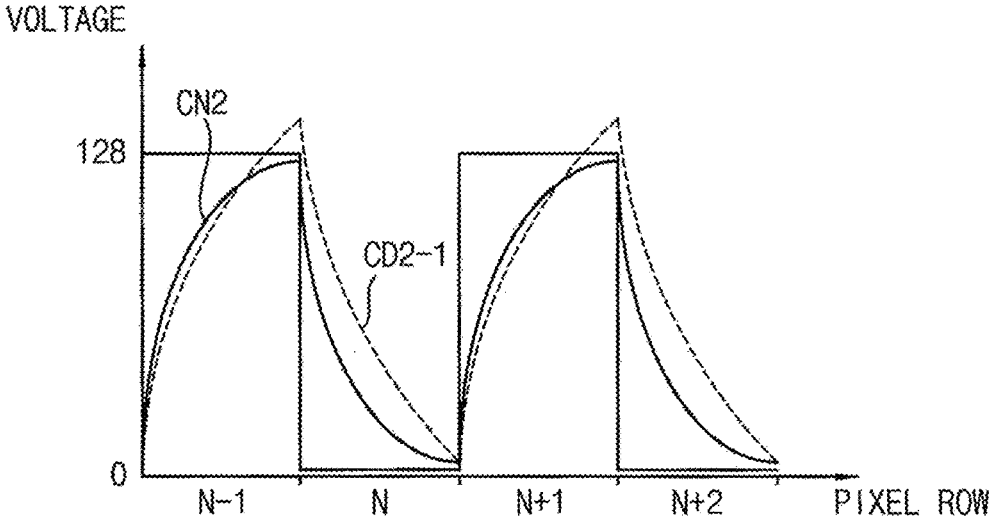
FIG. 7B is a graph illustrating compensation of the charging rate of the defected data line when the display panel of FIG. 2 displays the second image.

FIG. 6 is a conceptual diagram illustrating the display panel 100 of FIG. 2 which displays a second image. FIG. 7A is a graph illustrating a lack of a charging rate of the defected data line DL2 when the display panel 100 of FIG. 2 displays the second image. FIG. 7B is a graph illustrating compensation of the charging rate of the defected data line DL2 when the display panel 100 of FIG. 2 displays the second image.

Referring to FIGS. 1 to 3 and 6 to 7B, the data signal having 128 grayscale and the data signal having zero grayscale may be alternately applied to each of the second data line DL2 and the fifth data line DL5 and the data signal having zero grayscale may be applied to the other data lines (e.g., DL1, DL3, DL4, DL6, and DL7). Herein, it is assumed that the second data line DL2 may be the defected data line and the fifth data line DL5 may be the normal data line.

The charging rate of the pixels connected to the defected data line may be reduced. Thus, a data voltage corresponding to 128 grayscale may be charged to the pixels connected to the normal data line DL5 in a relatively high slope as illustrated as a first voltage CN2 of FIG. 7A and the data voltage corresponding to 128 grayscale may be charged to the pixels connected to the defected data line DL2 in a relatively low slope as illustrated as a second voltage CD2 of FIG. 7A. Thus, the lack of the charging rate of the pixels connected to the defected data line DL2 may generate the display defect.

The driving controller 200 may compensate the present data signal based on the previous data signal and the present data signal which are applied to the defected data line DL2. For example, the lack of the charging rate of the present data signal (the data signal corresponding to the N-th pixel row) may be compensated based on the previous data signal (the data signal corresponding to the (N−1)-th pixel row) and the present data signal (the data signal corresponding to the N-th pixel row). For another example, the lack of the charging rate of another present data signal (the data signal corresponding to the (N+1)-th pixel row) may be compensated based on another previous data signal (the data signal corresponding to the N-th pixel row) and the another present data signal (the data signal corresponding to the (N+1)-th pixel row).

As shown in FIG. 7B, when the previous data signal has zero grayscale and the present data signal has 128 grayscale, the compensated data signal CD2-1 which has a grayscale greater than 128 grayscale for the present data signal is applied to the defected data line DL2 so that the charging rate of the pixels connected to the defected data line DL2 may be compensated. Thus, the display defect due to the lack of the charging rate of the defected data line may be prevented.

Figure 8:
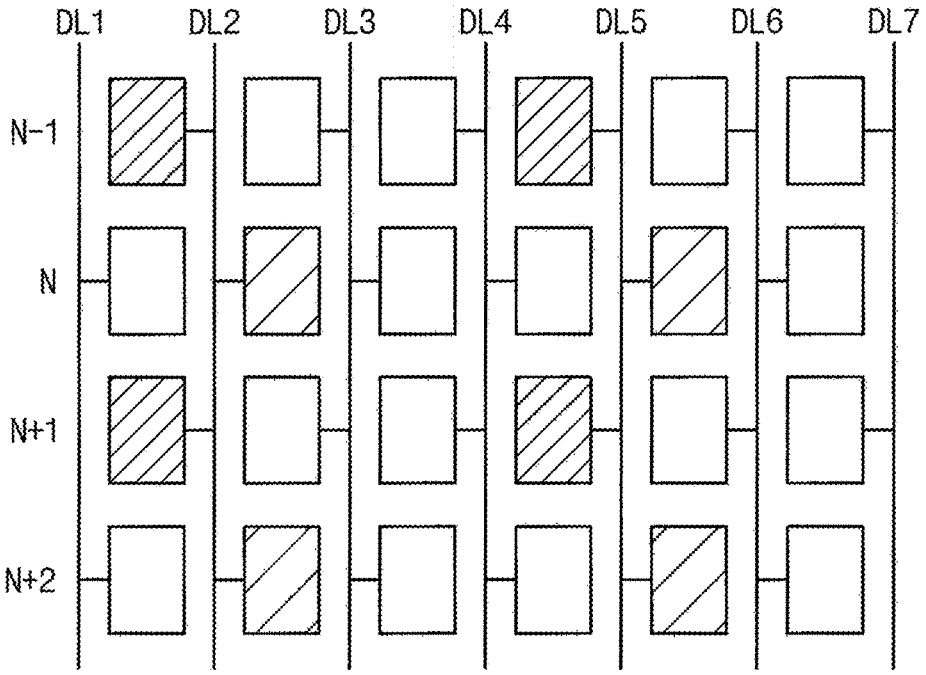
FIG. 8 is a conceptual diagram illustrating the display panel of FIG. 2 which displays a third image.
Figure 9A:
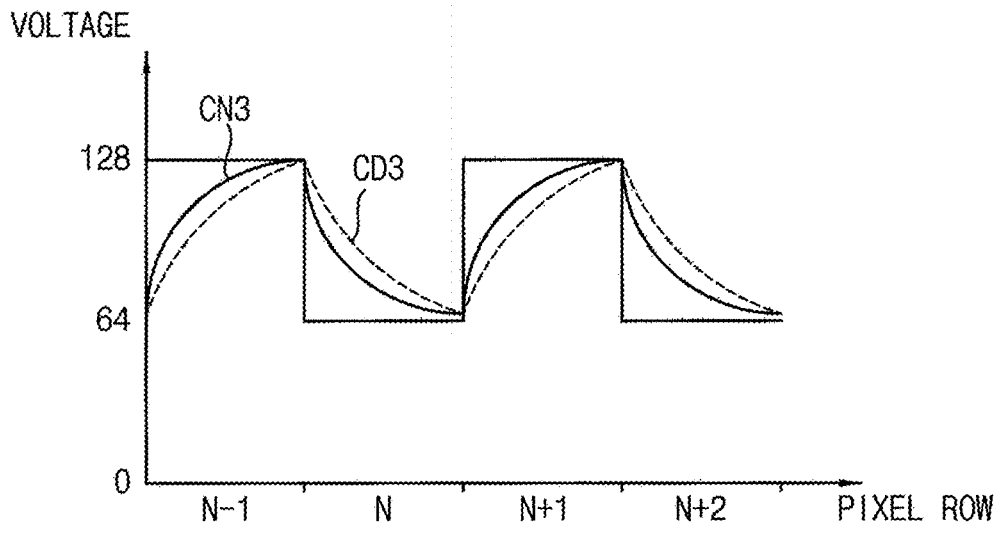
FIG. 9A is a graph illustrating a lack of a charging rate of the defected data line when the display panel of FIG. 2 displays the third image.
Figure 9B:
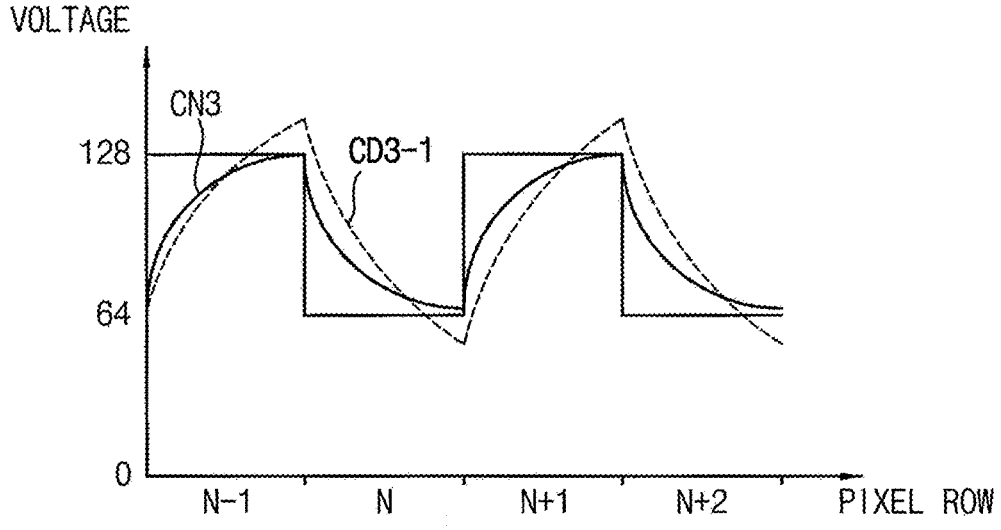
FIG. 9B is a graph illustrating compensation of the charging rate of the defected data line when the display panel of FIG. 2 displays the third image.

FIG. 8 is a conceptual diagram illustrating the display panel 100 of FIG. 2 which displays a third image. FIG. 9A is a graph illustrating a lack of a charging rate of the defected data line DL2 when the display panel 100 of FIG. 2 displays the third image. FIG. 9B is a graph illustrating compensation of the charging rate of the defected data line DL2 when the display panel 100 of FIG. 2 displays the third image.

Referring to FIGS. 1 to 3 and 8 to 9B, the data signal having 128 grayscale and the data signal having 64 grayscale may be alternately applied to each of the second data line DL2 and the fifth data line DL5 and the data signal having zero grayscale may be applied to the other data lines. Herein, it is assumed that the second data line DL2 may be the defected data line and the fifth data line DL5 may be the normal data line.

The charging rate of the pixels connected to the defected data line may be reduced. Thus, a data voltage corresponding to 128 grayscale and a data voltage corresponding to 64 grayscale may be charged to the pixels connected to the normal data line DL5 in a relatively high slope as illustrated as a first voltage CN3 of FIG. 9A and the data voltage corresponding to 128 grayscale and the data voltage corresponding to 64 grayscale may be charged to the pixels connected to the defected data line DL2 in a relatively low slope as illustrated as a second voltage CD3 of FIG. 9A. Thus, the lack of the charging rate of the pixels connected to the defected data line DL2 may generate the display defect.

The driving controller 200 may compensate the present data signal based on the previous data signal and the present data signal which are applied to the defected data line DL2. For example, the lack of the charging rate of the present data signal (the data signal corresponding to the N-th pixel row) may be compensated based on the previous data signal (the data signal corresponding to the (N−1)-th pixel row) and the present data signal (the data signal corresponding to the N-th pixel row). For another example, the lack of the charging rate of another present data signal (the data signal corresponding to the (N+1)-th pixel row) may be compensated based on another previous data signal (the data signal corresponding to the N-th pixel row) and the another present data signal (the data signal corresponding to the (N+1)-th pixel row).

As shown in FIG. 9B, when the previous data signal has 64 grayscale and the present data signal has 128 grayscale, the compensated data signal CD3-1 which has a grayscale greater than 128 grayscale for the present data signal is applied to the defected data line DL2 so that the charging rate of the pixels connected to the defected data line DL2 may be compensated. In addition, when the previous data signal has 128 grayscale and the present data signal has 64 grayscale, the compensated data signal CD3-1 which has a grayscale less than 64 grayscale for the present data signal is applied to the defected data line DL2 so that the charging rate of the pixels connected to the defected data line DL2 may be compensated. Thus, the display defect due to the lack of the charging rate of the defected data line may be prevented.

According to the present exemplary embodiments, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 10:
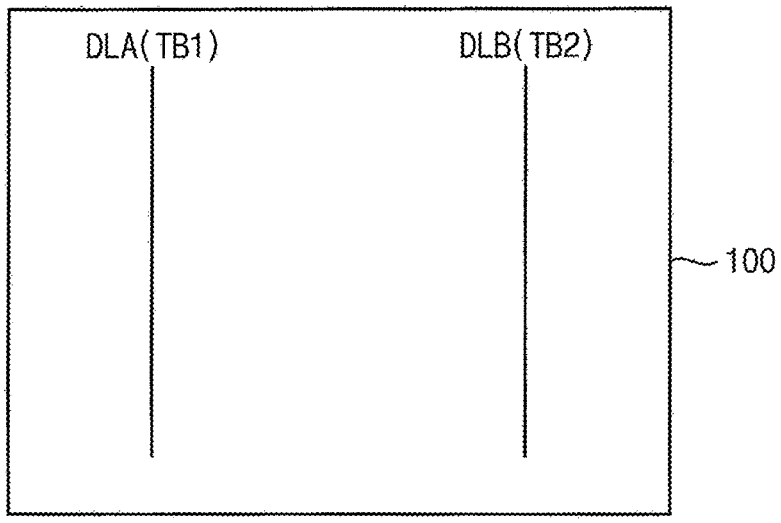
FIG. 10 is a conceptual diagram illustrating an exemplary embodiment of an operation of a driving controller according to the present inventive concept.

FIG. 10 is a conceptual diagram illustrating an exemplary embodiment of an operation of a driving controller according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except that a plurality of the compensating tables are generated corresponding to a plurality of the defected data lines. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 10, the display apparatus includes a display panel 100 and a display panel driver. The display panel driver includes a driving controller 200, a gate driver 300, and a data driver 500 and optionally includes a gamma reference voltage generator 400.

The driving controller 200 determines a compensating value of a present data signal based on a previous data signal and the present data signal which are applied to the same data line.

In the case that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the case that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

The driving controller 200 may generate a plurality of tables including various reference compensating values and compensating ratios for the plurality of the defected data lines.

For example, the driving controller 200 may store a first table TB1 including first reference compensating values and first compensating ratios for a first defected data line DLA and a second table TB2 including second reference compensating values and second compensating ratios for a second defected data line DLB.

Each of the first table TB1 and the second table TB2 may have a type of the table of FIG. 3. The first reference compensating values and the first compensating ratios in the first table TB1 may be different from the second reference compensating values and the second compensating ratios in the second table TB2.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 11:
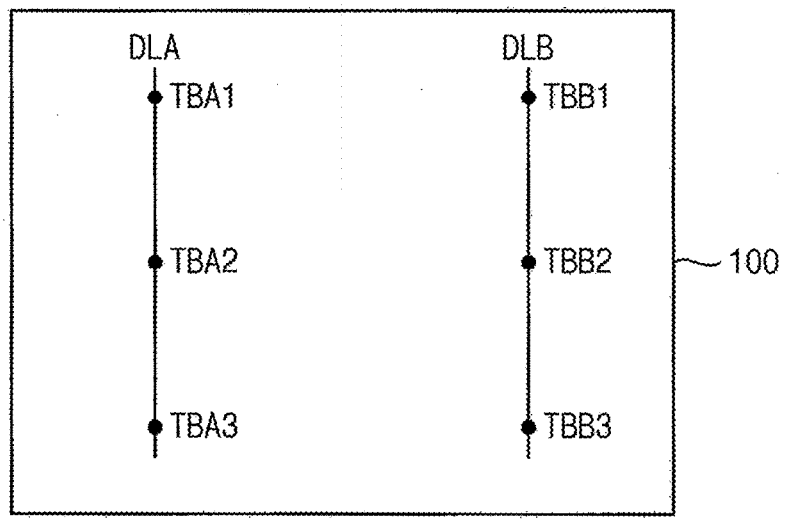
FIG. 11 is a conceptual diagram illustrating another exemplary embodiment of an operation of a driving controller according to the present inventive concept.

FIG. 11 is a conceptual diagram illustrating another exemplary embodiment of an operation of a driving controller according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except that a plurality of the compensating tables are generated corresponding to a single defected data line and the plurality of the compensating tables are generated corresponding to the plurality of the defected data lines. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 9B and 11, the display apparatus includes a display panel 100 and a display panel driver. The display panel driver includes a driving controller 200, a gate driver 300, and a data driver 500 and optionally includes a gamma reference voltage generator 400.

The driving controller 200 determines a compensating value of a present data signal based on a previous data signal and the present data signal which are applied to the same data line.

In the case that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the case that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

The driving controller 200 may generate a plurality of tables including various reference compensating values and compensating ratios according to a plurality of positions in the single defected data line.

For example, the driving controller 200 may store a first table TBA1 including first reference compensating values and first compensating ratios for a first position in a first defected data line DLA, a second table TBA2 including second reference compensating values and second compensating ratios for a second position in the first defected data line DLA and a third table TBA3 including third reference compensating values and third compensating ratios for a third position in the first defected data line DLA.

In addition, the driving controller 200 may generate a plurality of tables including various reference compensating values and compensating ratios for the plurality of the defected data lines.

For example, the driving controller 200 may store a fourth table TBB1 including fourth reference compensating values and fourth compensating ratios for a fourth position in a second defected data line DLB, a fifth table TBB2 including fifth reference compensating values and fifth compensating ratios for a fifth position in the second defected data line DLB and a sixth table TBB3 including sixth reference compensating values and sixth compensating ratios for a sixth position in the second defected data line DLB.

Each of the first to sixth tables TBA1, TBA2, TBA3, TBB1, TBB2 and TBB3 may have a type of the table of FIG. 3. The reference compensating values and the compensating ratios in the first to sixth tables TBA1, TBA2, TBA3, TBB1, TBB2 and TBB3 may be different from one another.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 12:
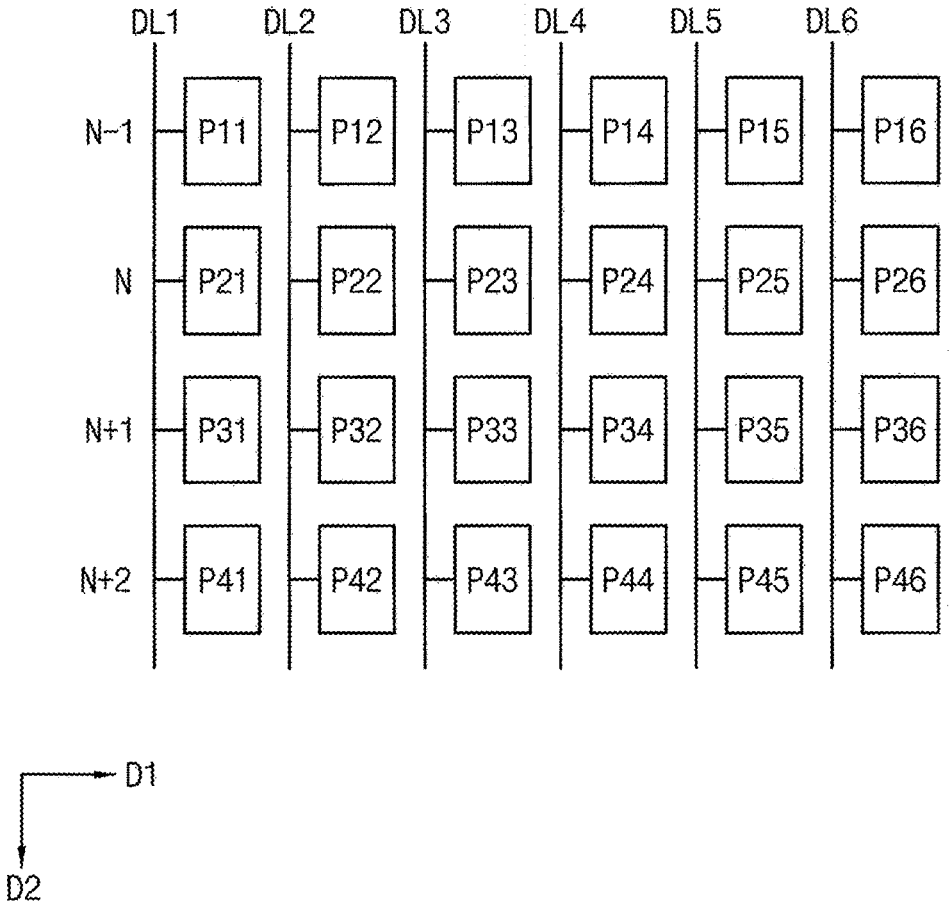
FIG. 12 is a conceptual diagram illustrating an exemplary embodiment of a pixel structure of a display panel according to the present inventive concept.

FIG. 12 is a conceptual diagram illustrating an exemplary embodiment of a pixel structure of a display panel according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except for the pixel structure of the display panel. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 9B and 12, the display apparatus includes a display panel 100 and a display panel driver. The display panel driver includes a driving controller 200, a gate driver 300, and a data driver 500 and optionally includes a gamma reference voltage generator 400.

The display panel 100 includes a plurality of pixels disposed in a matrix form. The pixel may have a shorter side extending in the first direction D1 and a longer side extending in the second direction D2.

In the present exemplary embodiment, each data line may be connected to pixels disposed in a single pixel column. For example, a first data line DL1 may be connected to pixels P11, P21, P31 and P41 in a first pixel column. For example, a second data line DL2 may be connected to pixels P12, P22, P32 and P42 in a second pixel column. For example, a third data line DL3 may be connected to pixels P13, P23, P33 and P43 in a third pixel column. For example, a fourth data line DL4 may be connected to pixels P14, P24, P34 and P44 in a fourth pixel column. For example, a fifth data line DL5 may be connected to pixels P15, P25, P35 and P45 in a fifth pixel column. For example, a sixth data line DL6 may be connected to pixels P16, P26, P36 and P46 in a sixth pixel column.

Although not shown in figures, pixels in a first pixel row N−1 may be connected to a first gate line, pixels in a second pixel row N may be connected to a second gate line, pixels in a third pixel row N+1 may be connected to a third gate line and pixels in a fourth pixel row N+2 may be connected to a fourth gate line.

Although the pixels in the four by six matrix are illustrated in FIG. 12 for convenience of explanation, the display panel 100 may include pixels other than the pixels in the four by six matrix.

For example, the pixels P11, P21, P31 and P41 in the first pixel column and the pixels P14, P24, P34 and P44 in the fourth pixel column may be first color pixels having a first color. For example, the pixels P12, P22, P32 and P42 in the second pixel column and the pixels P15, P25, P35 and P45 in the fifth pixel column may be second color pixels having a second color. For example, the pixels P13, P23, P33 and P43 in the third pixel column and the pixels P16, P26, P36 and P46 in the sixth pixel column may be third color pixels having a third color.

The driving controller 200 determines a compensating value of a present data signal based on a previous data signal and the present data signal which are applied to the same data line.

In the case that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the cases that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

In the present exemplary embodiment, the display panel 100 may include a first pixel P11 connected to the first data line DL1 and disposed in the first pixel row N−1 and the first pixel column, a second pixel P12 connected to the second data line DL2 and disposed in the first pixel row N−1 and the second pixel column, a third pixel P21 connected to the first data line DL1 and disposed in the second pixel row N and the first pixel column, and a fourth pixel P22 connected to the second data line DL2 and disposed in the second pixel row N and the second pixel column. The compensating value of the third pixel P21 may be generated based on the data signal of the first pixel P11 and the data signal of the third pixel P21.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 13:
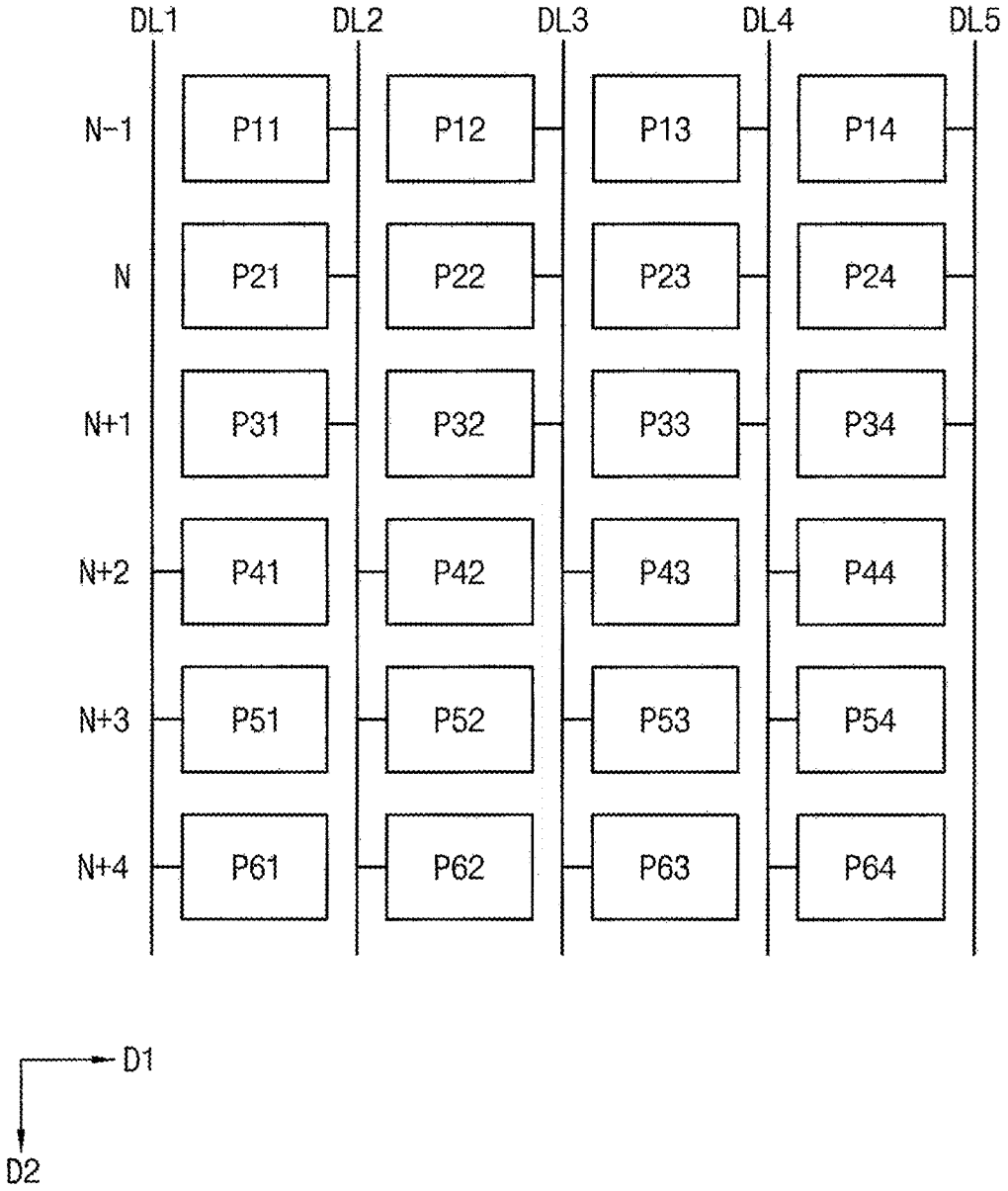
FIG. 13 is a conceptual diagram illustrating another exemplary embodiment of a pixel structure of a display panel according to the present inventive concept.

FIG. 13 is a conceptual diagram illustrating another exemplary embodiment of a pixel structure of a display panel according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except for the pixel structure of the display panel. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 9B and 13, the display apparatus includes a display panel 100 and a display panel driver. The display panel driver includes a driving controller 200, a gate driver 300, and a data driver 500 and optionally includes a gamma reference voltage generator 400.

The display panel 100 includes a plurality of pixels disposed in a matrix form. The pixel may have a longer side extending in the first direction D1 and a shorter side extending in the second direction D2.

In the present exemplary embodiment, the data line may be alternately connected to pixels disposed in two adjacent pixel columns by three pixels as shown in FIG. 13. For example, a second data line DL2 may be connected to pixels P11, P21 and P31 in a first pixel column and first to third pixel rows N−1, N, and N+1 and pixels P42, P52 and P62 in a second pixel column and fourth to sixth pixel rows N+2, N+3, and N+4.

Although not shown in figures, pixels in a first pixel row N−1 may be connected to a first gate line, pixels in a second pixel row N may be connected to a second gate line, pixels in a third pixel row N+1 may be connected to a third gate line, pixels in a fourth pixel row N+2 may be connected to a fourth gate line, pixels in a fifth pixel row N+3 may be connected to a fifth gate line and pixels in a sixth pixel row N+4 may be connected to a sixth gate line.

Although the pixels in the six by four matrix are illustrated in FIG. 13 for convenience of explanation, the display panel 100 may include pixels other than the pixels in the six by four matrix.

For example, the pixels P11 to P14 in the first pixel row N−1 and the pixels P41 to P44 in the fourth pixel row N+2 may be first color pixels having a first color. For example, the pixels P21 to P24 in the second pixel row N and the pixels P51 to P54 in the fifth pixel row N+3 may be second color pixels having a second color. For example, the pixels P31 to P34 in the third pixel row N+1 and the pixels P61 to P64 in the sixth pixel row N+4 may be third color pixels having a third color.

The driving controller 200 determines a compensating value of a present data signal based on a previous data signal and the present data signal which are applied to the same data line.

In the cases that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the cases that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

In the present exemplary embodiment, the display panel 100 may include a first pixel P11 connected to the second data line DL2 and disposed in the first pixel row N−1 and the first pixel column, a second pixel P12 connected to the third data line DL3 and disposed in the first pixel row N−1 and the second pixel column, a third pixel P21 connected to the second data line DL2 and disposed in the second pixel row N and the first pixel column, a fourth pixel P22 connected to the third data line DL3 and disposed in the second pixel row N and the second pixel column, a fifth pixel P31 connected to the second data line DL2 and disposed in the third pixel row N+1 and the first pixel column, a sixth pixel P32 connected to the third data line DL3 and disposed in the third pixel row N+1 and the second pixel column, a seventh pixel P41 connected to the first data line DL1 and disposed in the fourth pixel row N+2 and the first pixel column, and an eighth pixel P42 connected to the second data line DL2 and disposed in the fourth pixel row N+2 and the second pixel column, for example. The compensating value of the fifth pixel P31 may be generated based on the data signal of the third pixel P21 which is in the same pixel column as the fifth pixel P31 and the data signal of the fifth pixel P31. The compensating value of the eighth pixel P42 may be generated based on the data signal of the fifth pixel P31 which is in the different pixel column as the eighth pixel P42 and the data signal of the eighth pixel P42.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 14:
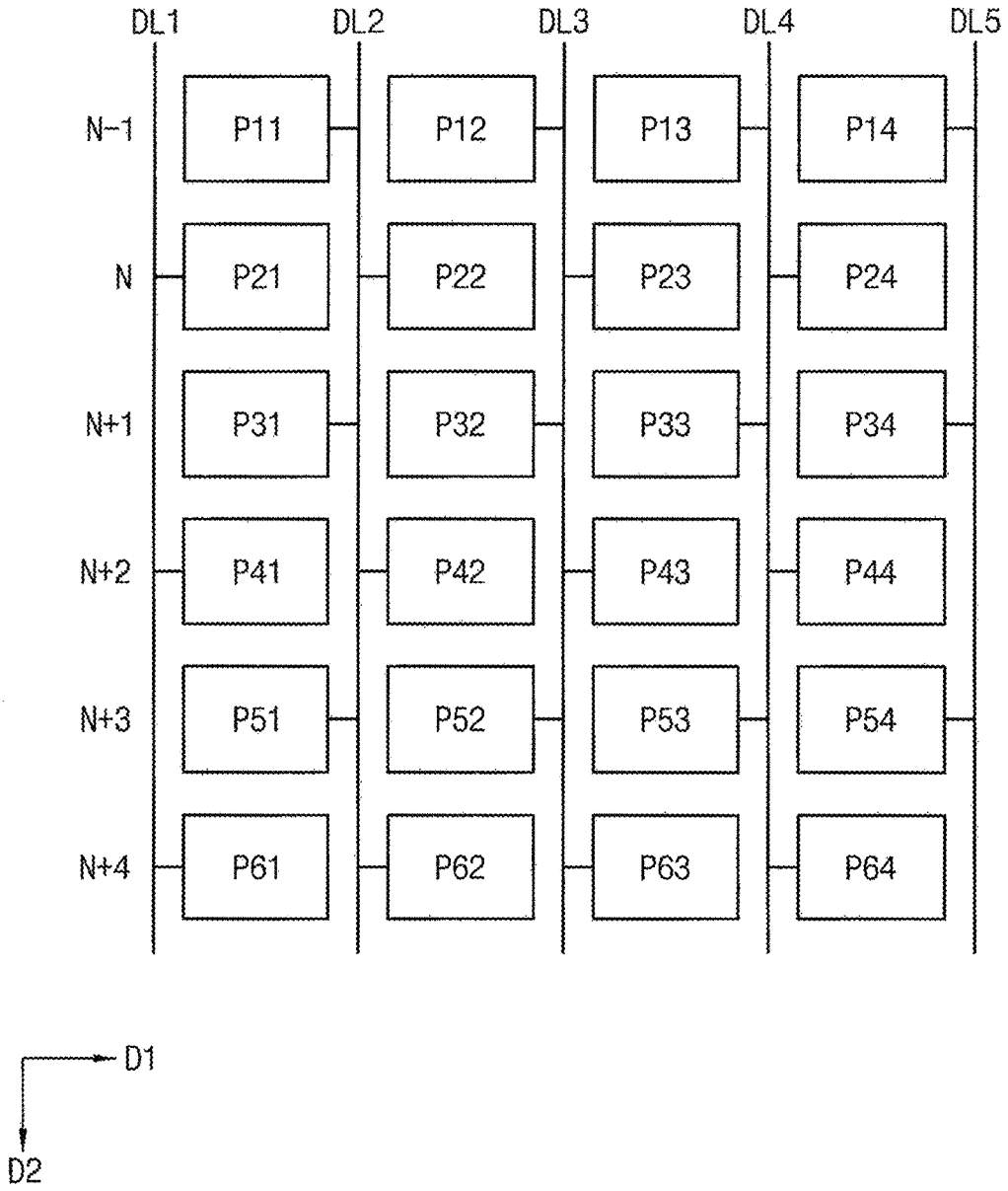
FIG. 14 is a conceptual diagram illustrating still another exemplary embodiment of a pixel structure of a display panel according to the present inventive concept.

FIG. 14 is a conceptual diagram illustrating still another exemplary embodiment of a pixel structure of a display panel according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except for the pixel structure of the display panel. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 9B and 14, the display apparatus includes a display panel 100 and a display panel driver. The display panel driver includes a driving controller 200, a gate driver 300, and a data driver 500 and optionally includes a gamma reference voltage generator 400.

The display panel 100 includes a plurality of pixels disposed in a matrix form. The pixel may have a longer side extending in the first direction D1 and a shorter side extending in the second direction D2.

In the present exemplary embodiment, the data line may be alternately connected to pixels disposed in two adjacent pixel columns by a pixel. For example, a second data line DL2 may be connected to pixels P11, P31 and P51 in a first pixel column and pixels P22, P42 and P62 in a second pixel column. For example, a third data line DL3 may be connected to pixels P12, P32 and P52 in the second pixel column and pixels P23, P43 and P63 in a third pixel column. For example, a fourth data line DL4 may be connected to pixels P13, P33 and P53 in the third pixel column and pixels P24, P44 and P64 in a fourth pixel column.

Although not shown in figures, pixels in a first pixel row N−1 may be connected to a first gate line, pixels in a second pixel row N may be connected to a second gate line, pixels in a third pixel row N+1 may be connected to a third gate line, pixels in a fourth pixel row N+2 may be connected to a fourth gate line, pixels in a fifth pixel row N+3 may be connected to a fifth gate line and pixels in a sixth pixel row N+4 may be connected to a sixth gate line.

Although the pixels in the six by four matrix are illustrated in FIG. 14 for convenience of explanation, the display panel 100 may include pixels other than the pixels in the six by four matrix.

For example, the pixels P11 to P14 in the first pixel row N−1 and the pixels P41 to P44 in the fourth pixel row N+2 may be first color pixels having a first color. For example, the pixels P21 to P24 in the second pixel row N and the pixels P51 to P54 in the fifth pixel row N+3 may be second color pixels having a second color. For example, the pixels P31 to P34 in the third pixel row N+1 and the pixels P61 to P64 in the sixth pixel row N+4 may be third color pixels having a third color.

The driving controller 200 determines a compensating value of a present data signal based on a previous data signal and the present data signal which are applied to the same data line.

In the cases that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the cases that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

Figure 15:
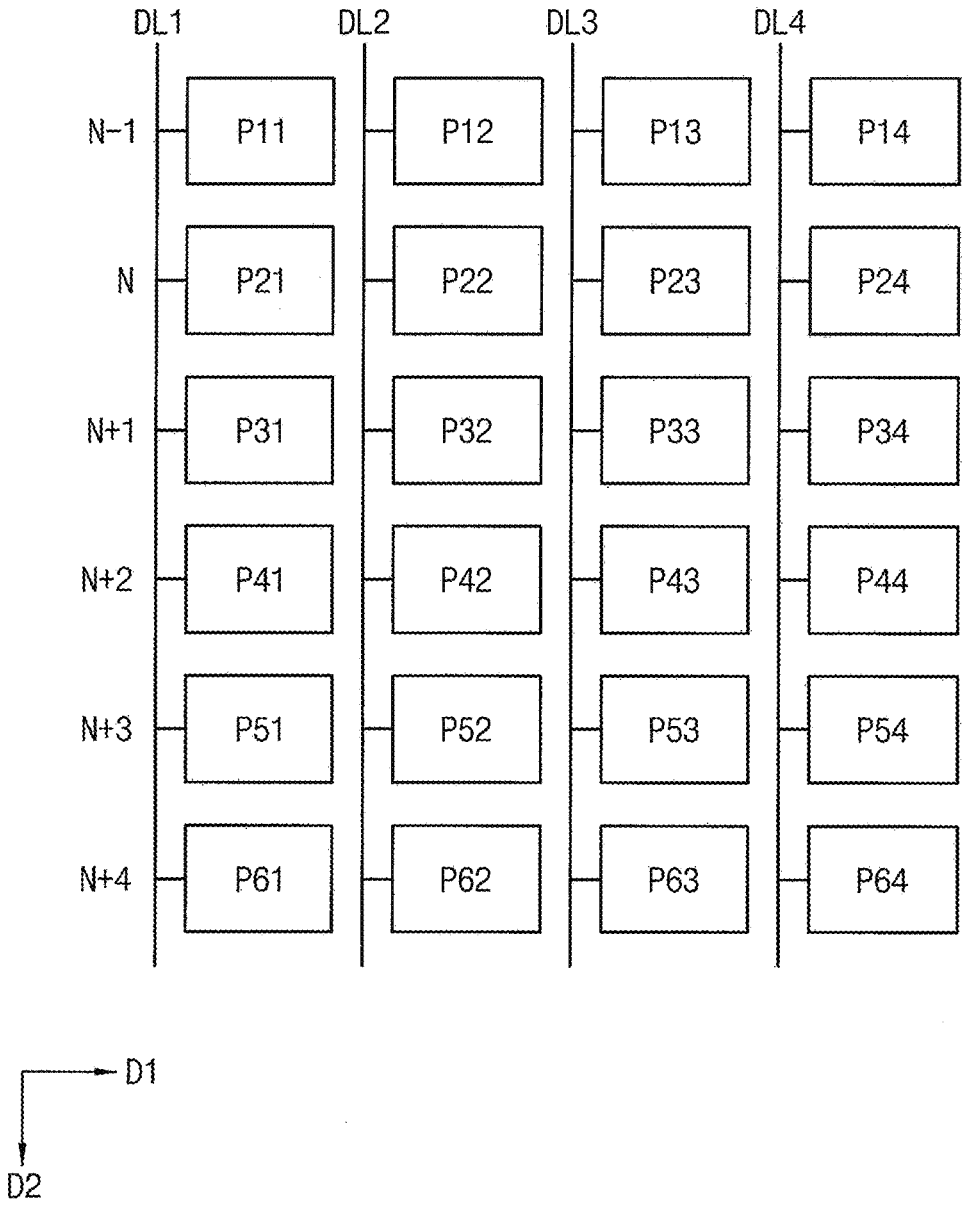
FIG. 15 is a conceptual diagram illustrating still another exemplary embodiment of a pixel structure of a display panel according to the present inventive concept.

FIG. 15 is a conceptual diagram illustrating still another exemplary embodiment of a pixel structure of a display panel according to the present inventive concept.

The display apparatus and the method of driving the display panel according to the present exemplary embodiment is substantially the same as the display apparatus and the method of driving the display panel of the previous exemplary embodiment explained referring to FIGS. 1 to 9B except for the pixel structure of the display panel. Thus, the same reference numerals will be used to refer to the same or like parts as those described in the previous exemplary embodiment of FIGS. 1 to 9B and any repetitive explanation concerning the above elements will be omitted.

Referring to FIGS. 1 to 9B and 15, the display apparatus includes a display panel 100 and a display panel driver. The display panel driver includes a driving controller 200, a gate driver 300, and a data driver 500 and optionally includes a gamma reference voltage generator 400.

The display panel 100 includes a plurality of pixels disposed in a matrix form. The pixel may have a longer side extending in the first direction D1 and a shorter side extending in the second direction D2.

In the present exemplary embodiment, each data line may be connected to pixels disposed in a single pixel column. For example, a first data line DL1 may be connected to pixels P11, P21, P31, P41, P51 and P61 in a first pixel column. For example, a second data line DL2 may be connected to pixels P12, P22, P32, P42, P52 and P62 in a second pixel column. For example, a third data line DL3 may be connected to pixels P13, P23, P33, P43, P53 and P63 in a third pixel column. For example, a fourth data line DL4 may be connected to pixels P14, P24, P34, P44, P54 and P64 in a fourth pixel column.

Although not shown in figures, pixels in a first pixel row N−1 may be connected to a first gate line, pixels in a second pixel row N may be connected to a second gate line, pixels in a third pixel row N+1 may be connected to a third gate line, pixels in a fourth pixel row N+2 may be connected to a fourth gate line, pixels in a fifth pixel row N+3 may be connected to a fifth gate line and pixels in a sixth pixel row N+4 may be connected to a sixth gate line.

Although the pixels in the six by four matrix are illustrated in FIG. 15 for convenience of explanation, the display panel 100 may include pixels other than the pixels in the six by four matrix.

For example, the pixels P11 to P14 in the first pixel row N−1 and the pixels P41 to P44 in the fourth pixel row N+2 may be first color pixels having a first color. For example, the pixels P21 to P24 in the second pixel row N and the pixels P51 to P54 in the fifth pixel row N+3 may be second color pixels having a second color. For example, the pixels P31 to P34 in the third pixel row N+1 and the pixels P61 to P64 in the sixth pixel row N+4 may be third color pixels having a third color.

The driving controller 200 determines a compensating value of a present data signal based on a previous data signal and the present data signal which are applied to the same data line.

In the cases that the previous data signal represents a minimum grayscale value (e.g. zero grayscale) and the present data signal represents a first grayscale value of a non-minimum grayscale value (e.g. 16 grayscale, 24 grayscale, 32 grayscale, 64 grayscale, 128 grayscale, 192 grayscale or 255 grayscale), the driving controller 200 may generate the compensating value (e.g. CMA, CMB, CMC, CMD, CME, CMF or CMG) of the present data signal as the reference compensating value.

In the cases that the previous data signal represents a second grayscale value of a non-minimum grayscale value (e.g. 16 grayscale, 24 grayscale, 32 grayscale, 64 grayscale, 128 grayscale, 192 grayscale or 255 grayscale) and the present data signal represents the first grayscale value (e.g. 16 grayscale, 24 grayscale, 32 grayscale, 64 grayscale, 128 grayscale, 192 grayscale or 255 grayscale), the driving controller 200 may generate a ratio of a compensating value to the reference compensating value (e.g. CMA, CMB, CMC, CMD, CME, CMF or CMG) as the compensating ratio.

The driving controller 200 may store the reference compensating value and the compensating ratio as a table form.

According to the present exemplary embodiment, the present data signal may be compensated using the previous data signal and the present data signal which are applied to the defected data line. Thus, the lack of the charging rate due to the defected data line may be compensated in a unit of the data line. Therefore, the display defect may be prevented so that the display quality of the display panel 100 may be enhanced.

According to the exemplary embodiments of the display apparatus and the method of driving the display panel, the charging rates of the pixels connected to the defected data line may be compensated so that the display quality of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a display panel comprising a plurality of gate lines, a plurality of data lines and a plurality of pixels, the pixels being connected to the gate lines and the data lines;

a driving controller which determines a compensating value of a present data signal based on a previous data signal and the present data signal which are applied to a same data line of the data lines;

a gate driver which outputs a gate signal to the gate line; and a data driver which generates a data voltage based on the present data signal and the compensating value and outputs the data voltage to the same data line, wherein the compensating value of the present data signal compensates for a lack of a charging rate of a pixel connected to the same data line which is a defective date line relative to a normal data line of the plurality of data lines.

2. The display apparatus of claim 1, wherein the driving controller determines the compensating value such that a charging rate of a second pixel connected to the defective data line of the data lines among the pixels becomes equal to a charging rate of a first pixel connected to the normal data line of the data lines among the pixels.

3. The display apparatus of claim 1, wherein the driving controller determines the compensating value such that a charging rate of the pixel connected to the defective data line of the data lines among the pixels becomes equal to a target charging rate.

4. The display apparatus of claim 1, wherein the driving controller generates the compensating value of the present data signal as a reference compensating value based on determination that the previous data signal represents a minimum grayscale value and the present data signal represents a first grayscale value, and wherein the driving controller generates a ratio of the compensating value to the reference compensating value as a compensating ratio based on determination that the previous data signal represents a second grayscale value of a non-minimum grayscale value and the present data signal represents the first grayscale value.

5. The display apparatus of claim 4, wherein the compensating value is decreased as a grayscale value of the previous data signal increases in a same grayscale value of the present data signal.

6. The display apparatus of claim 4, wherein the compensating value is increased as a grayscale value of the present data signal increases in a same grayscale value of the previous data signal.

7. The display apparatus of claim 4, wherein the driving controller stores the reference compensating value and the compensating ratio using a table form, wherein the reference compensating value includes first reference compensating values and second reference compensating values, and the compensating ratio includes first compensating ratios and second compensating ratios, and wherein the driving controller stores a first table including the first reference compensating values and the first compensating ratios for a first defected data line of the data lines and a second table including the second reference compensating values and the second compensating ratios for a second defected data line of the data lines.

8. The display apparatus of claim 4, wherein the driving controller stores the reference compensating value and the compensating ratio using a table form, wherein the reference compensating value includes first reference compensating values and second reference compensating values, and the compensating ratio includes first compensating ratios and second compensating ratios, and wherein the driving controller stores a first table including the first reference compensating values and the first compensating ratios for a first position of a first defected data line of the data lines and a second table including the second reference compensating values and the second compensating ratios for a second position of the first defected data line.

9. The display apparatus of claim 4, wherein the driving controller stores the reference compensating value and the compensating ratio using a table form, wherein the reference compensating value includes first, second, third and fourth reference compensating values, and the compensating ratio includes first, second, third and fourth compensating ratios, and wherein the driving controller stores a first table including the first reference compensating values and the first compensating ratios for a first position of a first defected data line of the data lines, a second table including the second reference compensating values and the second compensating ratios for a second position of the first defected data line, a third table including the third reference compensating values and the third compensating ratios for a third position of a second defected data line of the data lines and a fourth table including the fourth reference compensating values and the fourth compensating ratios for a fourth position of the second defected data line.

10. The display apparatus of claim 1, wherein the display panel comprises:

a first pixel connected to a second data line of the data lines and disposed in a first pixel row and a first pixel column;

a second pixel connected to a third data line of the data lines and disposed in the first pixel row and a second pixel column;

a third pixel connected to a first data line of the data lines and disposed in a second pixel row and the first pixel column; and a fourth pixel connected to the second data line and disposed in the second pixel row and the second pixel column, and wherein the compensating value of the fourth pixel is generated based on a data signal of the first pixel and a data signal of the fourth pixel, and the plurality of pixels includes the first, second, third and fourth pixels.

11. The display apparatus of claim 1, wherein the display panel comprises:

a first pixel connected to a first data line of the data lines and disposed in a first pixel row and a first pixel column;

a second pixel connected to a second data line of the data lines and disposed in the first pixel row and a second pixel column;

a third pixel connected to the first data line and disposed in a second pixel row and the first pixel column; and a fourth pixel connected to the second data line and disposed in the second pixel row and the second pixel column, and wherein the compensating value of the third pixel is generated based on a data signal of the first pixel and a data signal of the third pixel, and the plurality of pixels includes the first, second, third and fourth pixels.

12. The display apparatus of claim 1, wherein the display panel comprises:

a first pixel connected to a second data line of the data lines and disposed in a first pixel row and a first pixel column;

a second pixel connected to a third data line of the data lines and disposed in the first pixel row and a second pixel column;

a third pixel connected to the second data line and disposed in a second pixel row and the first pixel column;

a fourth pixel connected to the third data line and disposed in the second pixel row and the second pixel column;

a fifth pixel connected to the second data line and disposed in a third pixel row and the first pixel column;

a sixth pixel connected to the third data line and disposed in the third pixel row and the second pixel column;

a seventh pixel connected to a first data line of the data lines and disposed in a fourth pixel row and the first pixel column; and an eighth pixel connected to the second data line and disposed in the fourth pixel row and the second pixel column, wherein the compensating value of the fifth pixel is generated based on a data signal of the third pixel and a data signal of the fifth pixel, and wherein the compensating value of the eighth pixel is generated based on the data signal of the fifth pixel and a data signal of the eighth pixel, and the plurality of pixels includes the first to eighth pixels.

13. A method of driving a display panel, the method comprising:

determining a compensating value of a present data signal based on a previous data signal and the present data signal which are applied to a same data line of a plurality of data lines;

generating a data voltage based on the present data signal and the compensating value; and outputting the data voltage to the same data line of the display panel, wherein the compensating value of the present data signal compensates for a lack of a charging rate of a pixel connected to the same data line which is a defective date line relative to a normal data line of the plurality of data lines.

14. The method of claim 13, wherein the compensating value of the present data signal is determined such that a charging rate of a second pixel connected to the defective data line of the data lines becomes equal to a charging rate of a first pixel connected to the normal data line of the data lines.

15. The method of claim 13, wherein the compensating value of the present data signal is determined such that a charging rate of the pixel connected to the defective data line of the data lines becomes equal to a target charging rate.

16. The method of claim 13, wherein the determining the compensating value of the present data signal comprises:

generating the compensating value of the present data signal as a reference compensating value based on determination that the previous data signal represents a minimum grayscale value and the present data signal represents a first grayscale value; and generating a ratio of the compensating value to the reference compensating value as a compensating ratio based on determination that the previous data signal represents a second grayscale value of a non-minimum grayscale value and the present data signal represents the first grayscale value.

17. The method of claim 16, wherein the compensating value is decreased as the grayscale value of the previous data signal increases in a same grayscale value of the present data signal.

18. The method of claim 16, wherein the compensating value is increased as the grayscale value of the present data signal increases in a same grayscale value of the previous data signal.

19. The method of claim 16, wherein the reference compensating value includes first and second reference compensating values and the compensating ratio includes first and second compensating ratios, and wherein the determining the compensating value of the present data signal comprises:

storing a first table including the first reference compensating values and the first compensating ratios for a first defected data line of the data lines; and storing a second table including the second reference compensating values and the second compensating ratios for a second defected data line of the data lines.

20. The method of claim 16, wherein the reference compensating value includes first and second reference compensating values and the compensating ratio includes first and second compensating ratios, and wherein the determining the compensating value of the present data signal comprises:

storing a first table including the first reference compensating values and the first compensating ratios for a first position of a first defected data line of the data lines; and storing a second table including the second reference compensating values and the second compensating ratios for a second position of the first defected data line.

* * * * *